US006309185B1

(12) United States Patent
Shen

(10) Patent No.: US 6,309,185 B1
(45) Date of Patent: Oct. 30, 2001

(54) FLOW REGULATOR FOR WATER PUMP

(76) Inventor: Der-Fan Shen, 5F, No. 40, Fentzu Wei Chieh, Shan-Chung City, Taipei Hsien (TW)

( * ) Notice: Subject to any disclaimer, the term of this patent is extended or adjusted under 35 U.S.C. 154(b) by 0 days.

(21) Appl. No.: 09/414,013

(22) Filed: Oct. 6, 1999

(51) Int. Cl.[7] ..... F04B 49/00
(52) U.S. Cl. ..... 417/295
(58) Field of Search ..... 417/295, 279; 251/83, 63.6; 96/116; 116/66.7; 119/53; 366/165.4

(56) References Cited

U.S. PATENT DOCUMENTS

| | | | | |
|---|---|---|---|---|
| 3,836,285 | * | 9/1974 | Purtell | 417/34 |
| 3,868,198 | * | 2/1975 | Purtell | 417/53 |
| 3,873,239 | * | 3/1975 | Jamieson | 417/281 |
| 3,958,596 | * | 5/1976 | Garrard | 137/504 |
| 4,435,134 | * | 3/1984 | Okada et al. | 417/428 |
| 5,098,259 | * | 3/1992 | Ohtaki et al. | 417/308 |
| 5,112,199 | * | 5/1992 | Otaki et al. | 417/310 |
| 5,156,531 | * | 10/1992 | Schmid et al. | 417/295 |
| 5,411,375 | * | 5/1995 | Bauer | 417/295 |
| 5,873,704 | * | 2/1999 | Ota et al. | 417/222.2 |
| 5,902,094 | * | 5/1999 | Hoenisch et al. | 417/26 |
| 6,027,315 | * | 2/2000 | Hogan | 417/295 |

* cited by examiner

*Primary Examiner*—Teresa Walberg
*Assistant Examiner*—Daniel Robinson
(74) *Attorney, Agent, or Firm*—Pro-Techtor Inter-National Services

(57) ABSTRACT

A flow regulator for a water pump, working in conjunction with a water pump, having a pump, an inlet pipe, an outlet pipe with a water pressure, and a container. The flow regulator comprises: a main body, installed at the inlet pipe and having a passageway for water flowing through the inlet pipe; a chamber inside the main body; an entrance to the chamber on the main body; a control element, mounted inside the chamber and glidingly movable therein back and forth; a connecting pipe, conducting the water pressure in the outlet pipe to the chamber; and a spring. The water pressure causes the control element to move within the chamber, resulting in the passageway to be narrowed. The spring counters the water pressure, such that when the water pressure decreases the passageway is widened. Thereby the water pressure controls the flow of water, according to demand, such that start-stop cycles of the water pump are lengthened.

2 Claims, 3 Drawing Sheets

FLOW REGULATOR FOR WATER PUMP

BACKGROUND OF THE INVENTION

1. Field of the Invention

The present invention relates to a flow regulator for a water pump, which works by stabilizing the pressure difference between inlet and outlet of the water pump.

2. Description of Related Art

The water supply of modern high-rise buildings at times is not sufficient for a steady flow of water or, on the contrary, water pressure is too high, resulting in water splashing out of taps. For this reason, often water pumps are installed generating a control led water pressure within a certain range.

Methods for regulating water pressure generated by a water pump with a motor include regulating the speed of the motor and turning the motor on and off to keep the water pressure within a pressure range.

A start-stop system for regulating water pressure mainly comprises a water pump, a pressure-sensitive switch at the outlet of the water pump, and a container. The pressure-sensitive switch detects the water pressure at the outlet of the water pump and determines the pressure range. When the water pressure falls below a lower threshold, the pressure-sensitive switch turns on the pump, increasing the water pressure in the outlet. After the water pressure has risen above an upper threshold, the pressure-sensitive switch turns off the pump. The container is installed at the outlet, storing water when the pump is turned on and releasing water when the pump is turned off. Thus the water pressure will not change rapidly, and start-stop intervals of the water pump are lengthened.

A speed-regulating system for maintaining a constant water pressure has a motor, a pressure sensor and a speed controller, which regulates the speed of the motor according to pressure values read by the pressure sensor. Thus a stable water pressure is maintained.

As compared to a speed-regulating system, a conventional start-stop system has a motor with fixed speed which is just regulated by being turned on and off. After turning on the pump, an excess outflow of water resulting in too high a pressure leads to instant turning off of the pump. Start-stop cycles of the pump easily get too short, too much energy is consumed, and the lifetime of the pump is adversely affected. Furthermore, an excess outflow of water will obstruct the pump outlet, increasing the pressure therein, as well as load on the pump and energy consumption. Therefore, a start-stop system ideally is used with pumps that deliver about as much water as is needed for the intended water supply, such that turning on the pump lets the water pressure increase only slowly and short start-stop cycles are avoided.

Since the motor of a start-stop system, when turned on, delivers a constant quantity of water, but demand in a large building varies with time, the pump has to be sufficiently large. Most of the time, however, demand for water is low, and a large pump is a waste of resources. In addition, pressure generated by a large pump will not be stable.

On the other hand, a speed-regulating system allows quickly to adapt the delivered water quantity to needs, avoiding the shortcoming of start-stop systems. However, the components of a speed-regulating system, a speed-regulated motor and a speed controller, are expensive and need maintenance by qualified personnel. Costs of a speed-regulated system exceed that of a start-stop system and are too large a burden for small buildings. For this reason, speed-regulated systems are generally used only in large buildings.

SUMMARY OF THE INVENTION

The main object of the present invention is to provide a flow regulator for a water pump, which avoids too short start-stop cycles, saving energy and increasing the lifetime of the water pump.

Another object of the present invention is to provide a flow regulator for a water pump, which allows to regulate the flow of water at the inlet of the water pump to accommodate variations in demand of water.

The present invention can be more fully understood by reference to the following description and accompanying drawings.

DETAILED DESCRIPTION OF THE PREFERRED EMBODIMENT

Figure 1:
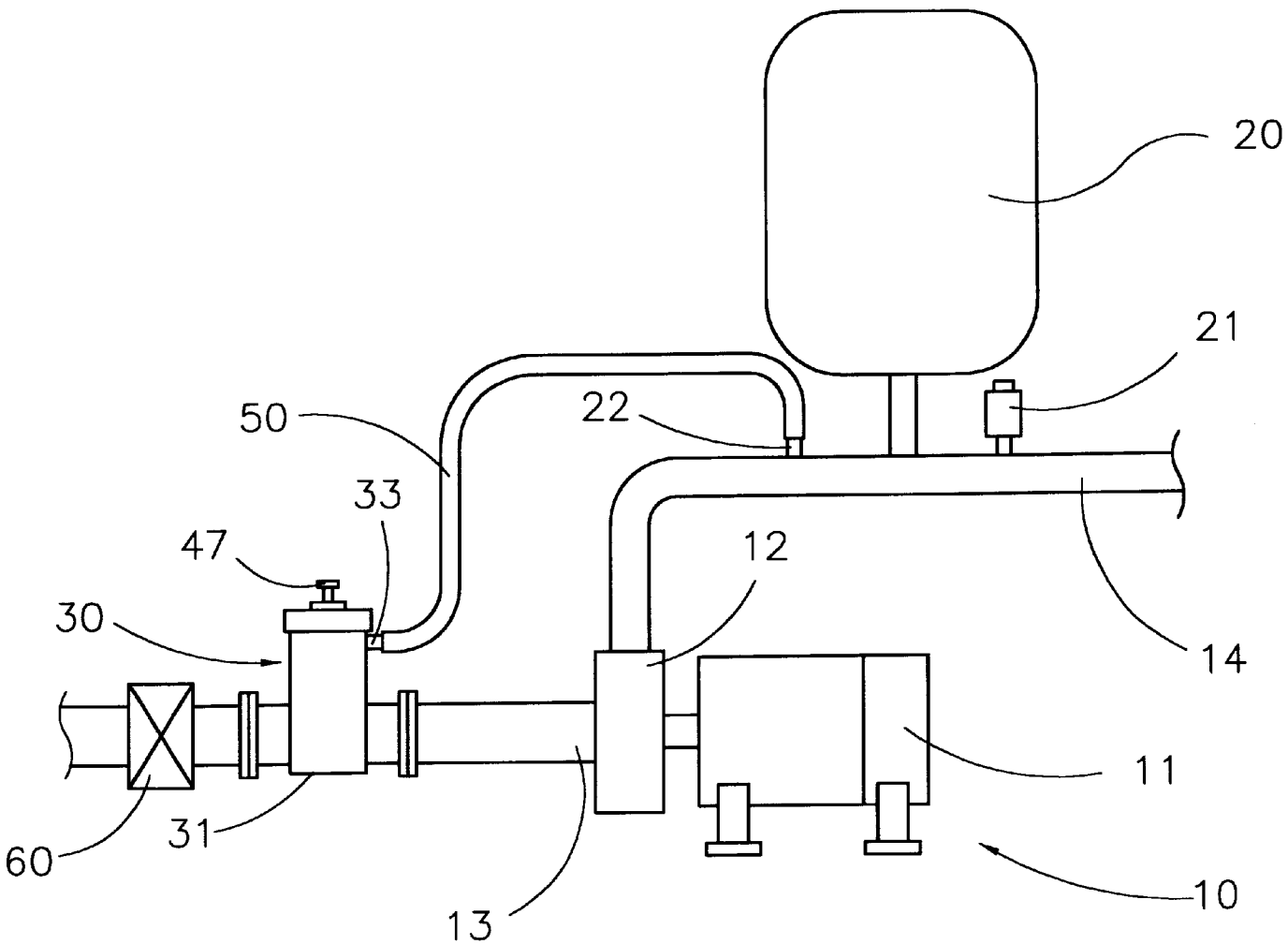
FIG. 1 is a schematic illustration of the flow regulator for a water pump of the present invention in conjunction with a water pump.

As shown in FIG. 1, the flow regulator for a water pump of the present invention is used in conjunction with a water pump 10, a container 20, and a pressure-sensitive switch 21. The water pump 10 has a motor 11; a pump 12, driven by the motor 11 and having an inlet and an outlet; a water inlet pipe 13, installed between the inlet of the pump 12 an a water supply; and a water outlet pipe 14, attached to the outlet of the pump 12 containing water with a water pressure to be led to delivery pipes.

The container 20 is mounted on the water outlet pipe 14. When the pump 12 is turned on, water enters the container 20. When the pump 12 is turned off, water from the container 20 replenishes the quantity of water in the delivery pipes, smoothing decrease of water pressure and avoiding to have to turn on the pump 12 again immediately. The pressure-sensitive switch 21 sits on the water outlet pipe 14, detecting the water pressure therein and controlling turning on and off of the motor 11 of the water pump 10.

The flow regulator for a water pump of the present invention mainly comprises a control valve 30 and a connecting pipe 50.

The control valve 30 is mounted on the water inlet pipe 13, controlling an inlet flow of water to the inlet of the pump 12. As shown in FIG. 1, the connecting pipe 50 conducts the water pressure from the outlet pipe 14 through a pressure outlet 22 back to the control valve 30.

The main characteristic of the present invention is that the water pressure in the water outlet pipe 14 controls the control valve 30, thus regulating the inlet flow of water according to demand of the delivery pipe. If, for instance, demand of the delivery pipe is high, the water pressure in the water outlet pipe 14 decreases, the control valve 30 opens further, and the inlet flow increases. On the other hand, if demand of the delivery pipe lowers, the water pressure in the water outlet pipe 14 increases, and the control valve 30 reduces the inlet flow.

Therefore the control valve 30 smoothes out large variations of the water pressure between times of large and small demands. In addition, rapid changes of the water pressure due to turning on and off the pump 12 are mitigated. Thus the object of saved energy and a prolonged lifetime of the pump 12 is achieved.

Figure 2:
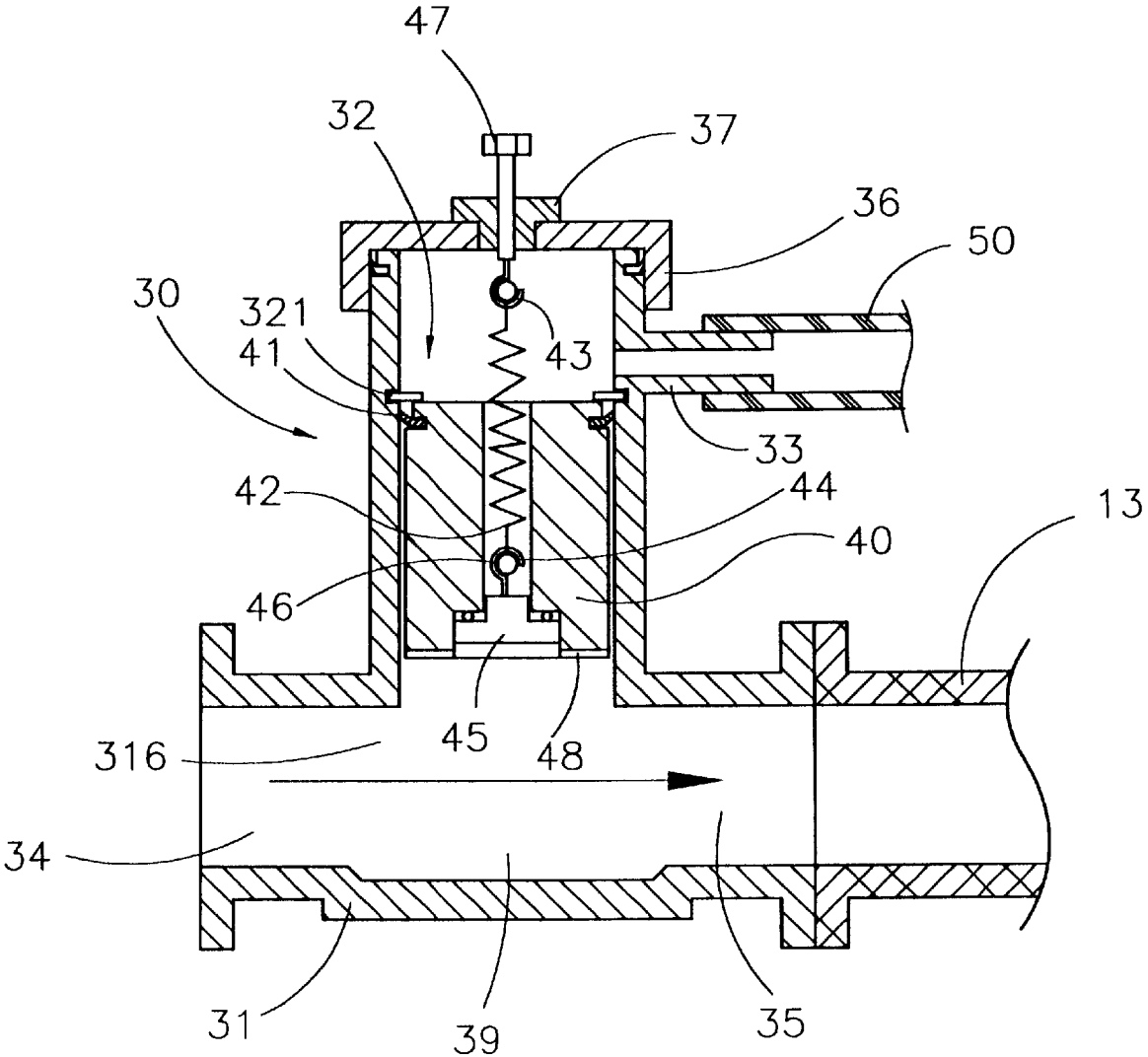
FIG. 2 is a sectional side view of the flow regulator for a water pump of the present invention.

Referring to FIG. 2, the control valve 30 comprises: a main body 31, having a cylindrical inner chamber 32 with an inner wall, defining a vertical direction with a top side; a lid 36 on the top side of the chamber 32, sealing the chamber 32 to the outside; an entrance 33, to which the connecting pipe 50 leads (as shown in FIG. 1) and through which water from the container 20 or the water outlet pipe 14 enters the chamber 32; a valve inlet 34 and a valve outlet 35, mounted on two opposite sides of the main body 31 and connected to the water inlet pipe 13; a passageway 39, located below the chamber 32 and connecting the valve inlet 34 and the valve outlet 35, such that water flows from the valve inlet 34 through the passageway 39 to the water outlet 35; a control element 40, having a bottom, glidingly movable in the chamber 32 in the vertical direction and sealed against the inner wall of the chamber 32 by several sealing rings 41; and a blocking valve 60 at the valve inlet 34, blocking a counterflow of water from the water outlet pipe 14 and the control valve 30, extending the lifetime of the sealing rings 41.

The entrance 33 is located above the control element 40. When the water pressure from the water outlet pipe 14 is conducted to the chamber 32, the control element 40 is pushed downward. A spring 42 connects the control element 40 and the top side of the chamber 32, developing an elastic force counter to the water pressure from the water outlet pipe 14. When the water pressure from the water outlet pipe 14 overcomes the elastic force of the spring 42, the control element 40 moves downward. When the water pressure from the water outlet pipe 14 decreases, the control element 40 moves back upward, driven by the elastic force of the spring 42.

Figure 3:
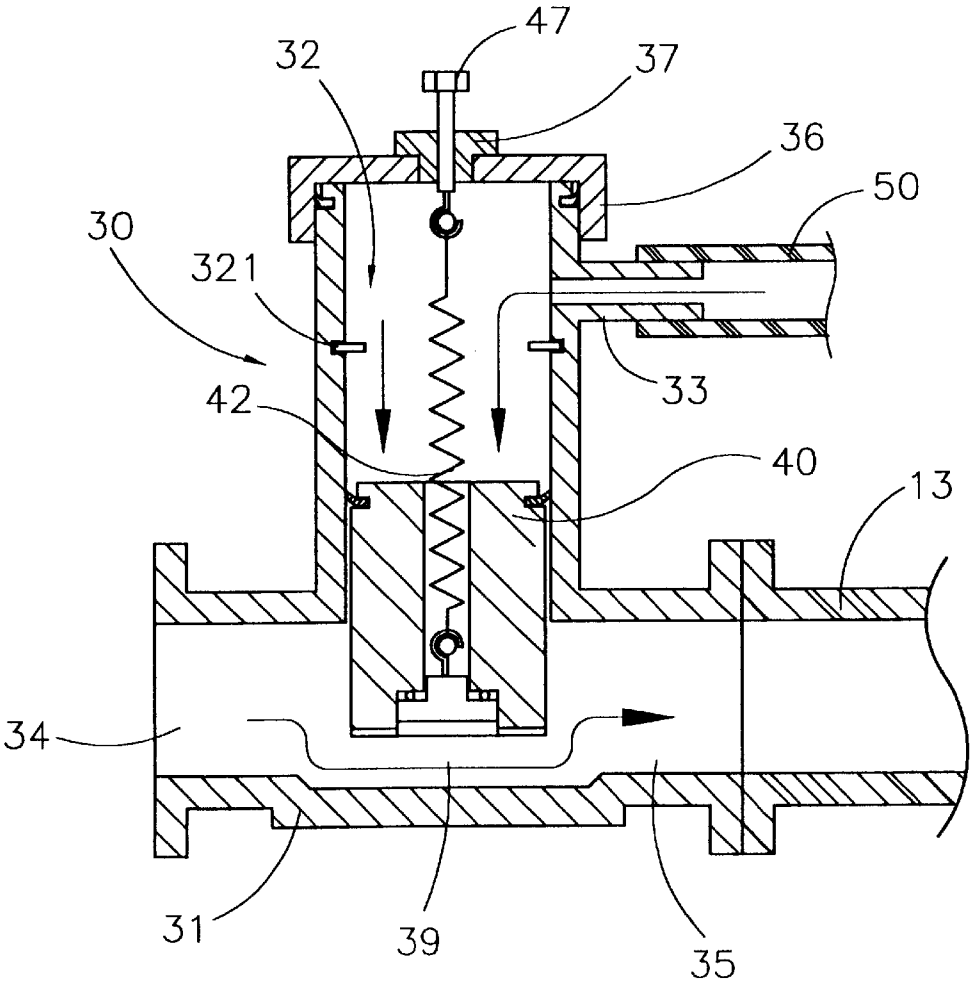
FIG. 3 is a schematic illustration of the movement of the present invention.

As shown in FIGS. 2 and 3, the control element 40, interacting with the spring 42, moves downward and upward in the chamber 32. The bottom of the control element 40 extends to the passageway 39. With the control element moving downward and upward, the passageway 39 is narrowed and widened, respectively. As shown in FIG. 3, when the water pressure from the outlet pipe 14 increases, the control element 40 is pushed downward, narrowing the passageway 39 and causing the inlet flow to decrease. On the other hand, as shown in FIG. 2, when the water pressure from the outlet pipe 14 decreases, the control element 40 is pushed upward by the elastic force of the spring 42, widening the passageway 39 and causing the inlet flow to increase. A blocking ring 321 on the inner wall of the chamber 32 blocks the control element 40 from rising above an uppermost position.

Figure 4:
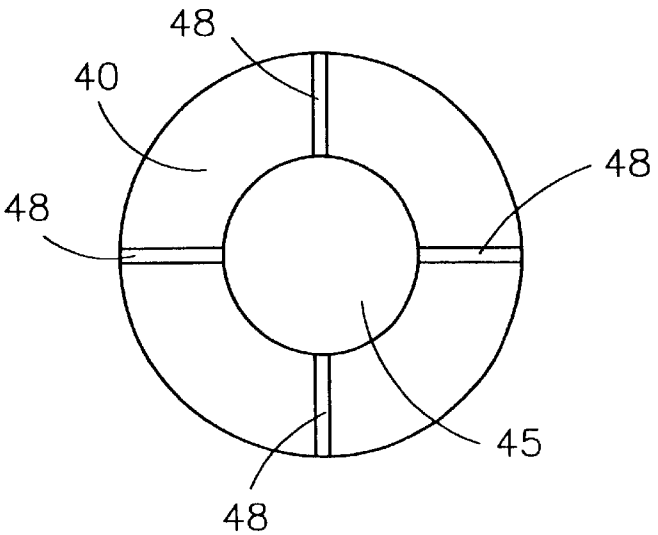
FIG. 4 is a bottom view of the control element of the present invention.

Referring to FIG. 4, several flow grooves 48 are cut into the bottom of the control element to ensure that even in an extreme lower position of the control element 40 some water reaches the pump 12 through the inlet pipe 13. As shown in FIG. 1, the blocking valve 60 at the valve inlet 34 blocks any counterflow of water from the water outlet pipe 14 and the control valve 30.

Controlling the inlet flow according to the water pressure by the control valve 30 requires proper adjusting of the spring 42. Since different types of pumps generally produce different water pressures, various types of pumps need various adjustments of the spring 42, so as to have a proper width of the passageway 39 at a given water pressure resulting in the proper inlet flow.

Referring again to FIG. 2, the elastic force of the spring is adjusted in the following way: A vertical channel 44 passes through the control element 40, having a lower end, which is covered from below by a plug 45. The plug 45 has an upper side, to which a hook 46 is attached. A threaded seat 37 is set in the lid 36. An adjusting screw 47 is inserted in the threaded seat 37, vertically above the channel 44, having a lower side that reaches into the chamber 32 and to which a hook 43 is attached.

The spring 42 has a lower end that passes through the channel 44 and is held by the hook 46. When the control element 40 is pushed downward by the water pressure, the spring 42 is lengthened and stores elastic energy. The amount of the elastic energy stored is controlled by turning the adjusting screw 47 within the threaded seat 37. This adjusts the inlet flow for a given water pressure to all types of pumps.

The present invention, using the control valve 30, allows to control the quantity of water delivered by the pump 12, according to demand. The main features are as follows:

1. When the quantity of water delivered by the water pump 10 exceeds demand, the control valve 30 throttles the inlet flow in the inlet pipe 13, adjusting to the demand and avoiding building up of high water pressure in the outlet pipe 14. Then the water pump 10 runs in a stable state with long start-stop cycles. Energy is saved, and the lifetime of the water pump 10 is extended. When, on the contrary, demand for water becomes larger than the quantity of water delivered by the water pump 10, the control valve 30 increases the inlet flow in the inlet pipe 13, and again stable water pressure in the outlet pipe 14 is kept.

2. When the quantity of water delivered by the water pump 10 exceeds demand, load on the pump 12 is low, and the water pressure will not rise excessively. Operation of the pump 12 is efficient with little wear.

3. The present invention gives a start-stop system almost the same effect as a speed-regulating system for a water pump, while costs are much lower. Thus great cost savings are achieved.

While the invention has been described with reference to a preferred embodiment thereof, it is to be understood that modifications or variations may be easily made without departing from the spirit of this invention which is defined by the appended claims.

What is claimed is:

1. A flow regulator in combination with a water pump comprising:

a main body installed in line with an inlet pipe of said pump, said main body has a passageway to receive water flowing through said inlet pipe, a sleeve mounted on said top side of said main body and having an interior chamber, an entrance on said main body that allows water to flow from said inlet pipe into said chamber of said sleeve, a control element movably mounted inside said chamber, said control element includes a biasing spring that opposes said water pressure, and an adjusting device that can be moved by a user of said flow regulator to adjust an elastic force of said spring; such that said control element narrows said passageway as said control element moves in response to an increase in a water pressure in said outlet pipe, and said control element widens said passageway as said control element moves in response to a decrease in a water pressure in said outlet pipe, said control element thereby regulating a flow rate in said inlet pipe, and said adjusting device controls an equilibrium point of said flow regulator, said equilibrium point being defined by means of said elastic force of said spring.

2. The flow regulator in combination with a water pump of claim 1 wherein:

said adjusting device comprises a screw in contact with said spring.

* * * * *